US006492953B2

(12) United States Patent
Apostolos

(10) Patent No.: US 6,492,953 B2
(45) **Date of Patent: *Dec. 10, 2002**

(54) WIDEBAND MEANDER LINE LOADED ANTENNA

(75) Inventor: John T. Apostolos, Merrimack, NH (US)

(73) Assignee: BAE Systems Information and Electronic Systems Integration Inc., Nashua, NH (US)

( * ) Notice: Subject to any disclaimer, the term of this patent is extended or adjusted under 35 U.S.C. 154(b) by 0 days.

This patent is subject to a terminal disclaimer.

(21) Appl. No.: 09/870,875

(22) Filed: May 31, 2001

(65) Prior Publication Data

US 2002/0008668 A1 Jan. 24, 2002

Related U.S. Application Data

(63) Continuation-in-part of application No. 09/865,115, filed on May 24, 2001, now Pat. No. 6,323,814.
(60) Provisional application No. 60/208,195, filed on May 31, 2000.

(51) Int. Cl.[7] ..... H01Q 11/14
(52) U.S. Cl. ..... 343/744; 343/741; 343/745
(58) Field of Search ..... 343/741, 744, 343/745, 742, 866, 867; H01Q 11/14

(56) References Cited

U.S. PATENT DOCUMENTS

| | | | | |
|---|---|---|---|---|
| 4,243,990 A | | 1/1981 | Nemit et al. | 343/771 |
| 4,293,858 A | | 10/1981 | Hockham | 343/731 |
| 4,804,965 A | | 2/1989 | Roederer | 343/700 MS |
| 5,086,301 A | | 2/1992 | English et al. | 342/188 |
| 5,481,272 A | | 1/1996 | Yarsunas | 343/797 |
| 5,563,616 A | | 10/1996 | Dempsey et al. | 343/753 |
| 5,784,032 A | | 7/1998 | Johnson et al. | 343/702 |
| 5,790,080 A | | 8/1998 | Apostolos | 343/744 |
| 5,898,409 A | | 4/1999 | Holzman | 343/786 |
| 6,008,762 A | | 12/1999 | Nghiem | 343/700 MS |
| 6,025,812 A | | 2/2000 | Gabriel et al. | 343/797 |
| 6,034,637 A | | 3/2000 | McCoy et al. | 343/700 MS |
| 6,094,170 A | | 6/2000 | Peng | |
| 6,323,814 B1 | * | 11/2001 | Apostolos | 343/744 |

FOREIGN PATENT DOCUMENTS

| | | |
|---|---|---|
| WO | WO 98/49742 | 11/1998 |
| WO | WO 01/13464 | 2/2001 |

* cited by examiner

*Primary Examiner*—Hoanganh Le
(74) *Attorney, Agent, or Firm*—Maine & Asmus

(57) ABSTRACT

A meander line loaded antenna provides a wide instantaneous bandwidth with a first planar conductor extending orthogonally from a ground plane, a second planar conductor substantially parallel to the ground plane and separated from the first planar conductor by a gap, a meander line interconnecting the first and second planar conductors across the gap, and a third conductor connecting the second planar conductor to ground. The antenna may be arranged in opposed pairs, and also as two orthogonally opposed pairs forming a quadrature antenna. Each of the individual antennas, the opposed pairs of individual antennas, and the quadrature antennas may be stacked with each lower antenna forming the ground plane for the antenna mounted thereon.

20 Claims, 8 Drawing Sheets

WIDEBAND MEANDER LINE LOADED ANTENNA

RELATED APPLICATION

Applicant hereby claims the priority benefits in accordance with the provisions of 35 U.S.C. §119, basing said claim on U.S. Provisional Patent Application Ser. No. 60/208,195 filed May 31, 2000 and claims the priority benefits as a Continuation in Part in accordance with the provisions of 35 U.S.C. §120, basing said claim on U.S. patent application Ser. No. 09/865,115 filed May 24, 2001, now U.S. Pat. No. 6,323,814.

BACKGROUND OF THE INVENTION

1. Field of the Invention

The present invention generally relates to high frequency, loop antennas and, particularly, to such antennas having a series reactance in the loop.

In the past, efficient antennas have typically required structures with minimum dimensions on the order of a quarter wavelength of the lowest operating frequency. These dimensions allowed the antenna to be excited easily and to be operated at or near resonance, limiting the energy dissipated in impedance losses and maximizing the transmitted energy. These antennas tended to be large in size at the resonant wavelength, and especially so at lower frequencies.

2. Discussion of the Related Art

In order to address the shortcomings of traditional antenna design and functionality, the meander line loaded antenna (MLA) was developed. One such antenna is disclosed in U.S. Pat. No. 5,790,080 for MEANDER LINE LOADED ANTENNA, issued to John T. Apostolos, the inventor of the present application, the contents of which are hereby incorporated by reference.

The aforementioned U.S. Pat. No. 5,790,080 describes an antenna that includes two or more conductive elements acting as radiating antenna elements, and a slow wave meander line adapted to couple electrical signals between the conductive elements. The meander line has a variable physical length which affects the electrical length and operating characteristics of the antenna. The electrical length of the meander line, and therefore the antenna, may be readily controlled.

More specifically, such an antenna includes two, spaced-apart vertical conductors and a horizontal conductor. The vertical and horizontal conductors are separated by gaps, which are bridged by meander lines. The meander lines include a slow wave structure having sequential sections with alternating high and low impedance values, which structure provides an electrical length that is greater than its physical length.

A meander line 108 according to the prior art is shown in FIG. 1 and is characterized by a plurality of series connected sections 110, 112. Sections 110, 112 are alternately sequentially connected and are designed to have respective high and low characteristic impedance values, which impedance values are sequentially alternated by the alternating sequential connection. These alternating impedance values create a slow wave structure having an effective electrical length that is greater than the actual physical length. This impedance structure may be formed by a transmission line having sections which alternate in their separation from a ground plane. In FIG. 1, high impedance sections 110 are suspended above the top surface of a dielectric sheet 114 and low impedance sections are formed as conductors directly on the top surface of dielectric sheet 114. Placing the dielectric sheet against a large planar conductor creates the different impedance values because the planar conductor acts as an effective ground plane. In the prior art antenna, the vertical or horizontal conductors of the antenna may be used to create that ground plane for meander line 108.

Meander line 108 is also designed to allow adjustment of its length. The slow wave structure permits lengths of the meander line to be switched in or out of the circuit quickly and with negligible loss, in order to change the effective length of the antenna. This switching is possible because active switching devices are located between the high and low impedance sections of the meander line. This keeps the current level through the switching device low and results in very low dissipation losses in the switch, thereby maintaining high antenna efficiency.

The MLA allows the physical dimensions of antennas to be significantly reduced while maintaining an electrical length that is still a multiple of a quarter wavelength. Antennas and radiating structures built using this design operate in the region where the limitation on their fundamental performance is governed by the Chu-Harrington relation. Meander line loaded antennas achieve the efficiency limit of the Chu-Harrington relation while allowing the antenna size to be much less than a quarter wavelength at the frequency of operation. Height reductions of 10 to 1 can be achieved over quarter wave monopole antennas while achieving comparable gain.

The prior art MLA antennas have relatively narrow instantaneous bandwidth. Although the switchable meander line allows the antennas to have a very wide tunable bandwidth, the bandwidth available for simultaneous or instantaneous use is relatively limited. Thus for multi-band or multi-use applications and for applications where signals can appear unexpectedly over a wide frequency range, existing MLA antennas are somewhat limited.

Further, as the use of wireless signaling proliferates across the useable spectrum and especially on mobile platforms, the need for wide band or multi-band antennas will only grow in response to the requirement for aperture and volumetric efficiency for the antennas of such systems.

SUMMARY OF THE INVENTION

It is, therefore, an object of the invention to provide a meander line loaded antenna (MLA) having a wide instantaneous bandwidth.

It is a still further object of the invention to provide such an antenna which may be replicated in different sizes to create multi-band antennas.

Accordingly, a wide band, meander line loaded antenna includes a first planar conductor extending orthogonally from a ground plane, a signal coupling device connected to the first planar conductor proximally to the ground plane, a second planar conductor substantially parallel to the ground plane and separated from the first planar conductor by a gap, a meander line interconnecting the first and second planar conductors across the gap, and a third conductor connecting the second planar conductor to ground.

Alternatively, the present antenna may be arranged in opposed pairs, and also as two orthogonally opposed pairs for functioning as a quadrature antenna.

Further, each of the antennas, whether singular, opposed pair or quadrature may be replicated as a smaller version and mounted on top of the original with the second planar conductor of the original antenna functioning as the ground plane for the smaller version.

BRIEF DESCRIPTION OF THE DRAWINGS

A complete understanding of the present invention may be obtained by reference to the accompanying drawings, when considered in conjunction with the subsequent detailed description, in which.

DETAILED DESCRIPTION OF THE DRAWINGS

Figure 2:
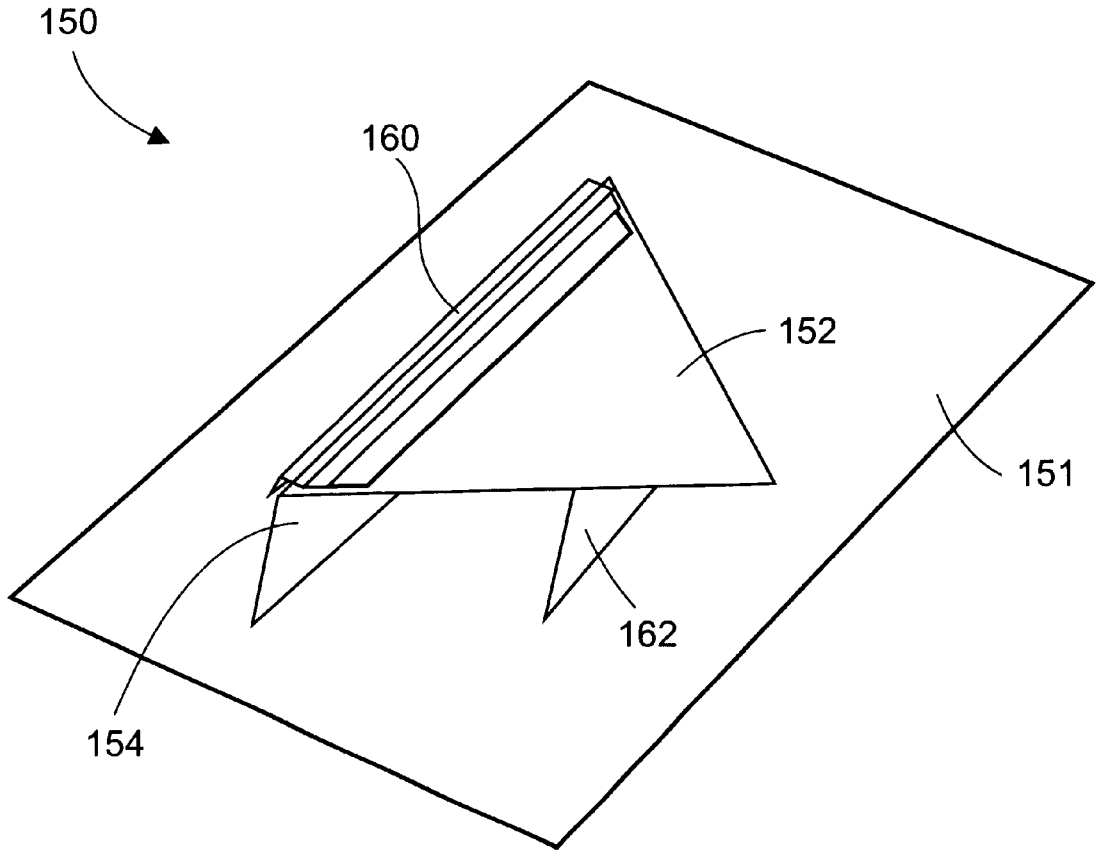
FIG. 2 is a perspective view of a meander line loaded antenna constructed in accordance with one embodiment of the present invention.

The present application discloses an enhanced meander line loaded antenna, which exhibits a wide instantaneous bandwidth and is replicable and combinable for providing multi-band coverage. Several versions of such an enhanced antenna are shown in FIGS. 2, 3A, 3B and 3C. FIG. 2 shows an antenna 150, in a perspective view, mounted on a ground plane 151 and generally including a vertical planar conductor 154, a horizontal planar conductor 152, and a third conductor 162 connecting the horizontal planar conductor 152 to ground. Also included is a shaped conductor 160 connected to horizontal conductor 152 and extending towards vertical conductor 154.

The words vertical and horizontal are nominally used throughout this application with reference to a ground plane. A ground plane may readily take the form of a finite planar conductor which may be oriented in an infinite number of positions without affecting the operation of the antenna relative thereto. Thus, the terms vertical and horizontal are not intended to limit the functional position of the claimed antennas.

Figure 3A:
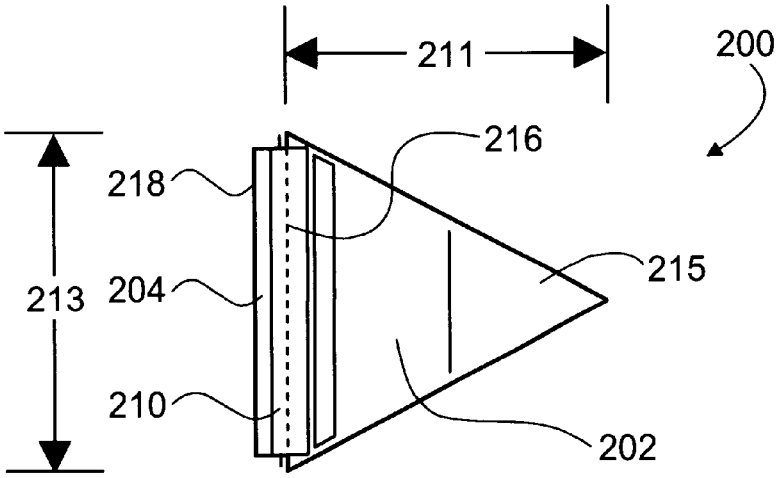
FIG. 3A is a top view of an antenna constructed in accordance with another embodiment of the present invention.
Figure 3B:
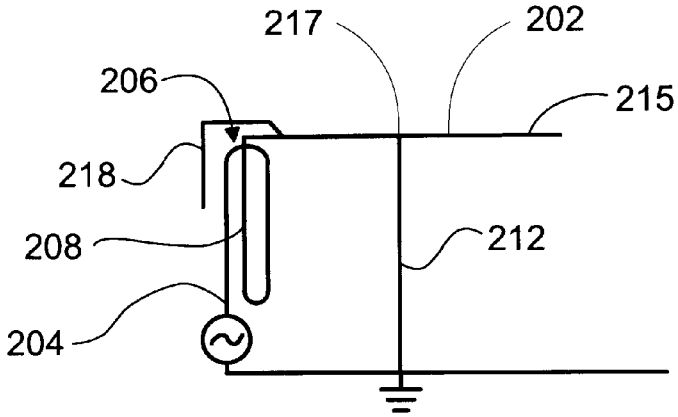
FIG. 3B is a schematic side view of the antenna of FIG. 3A.
Figure 3C:
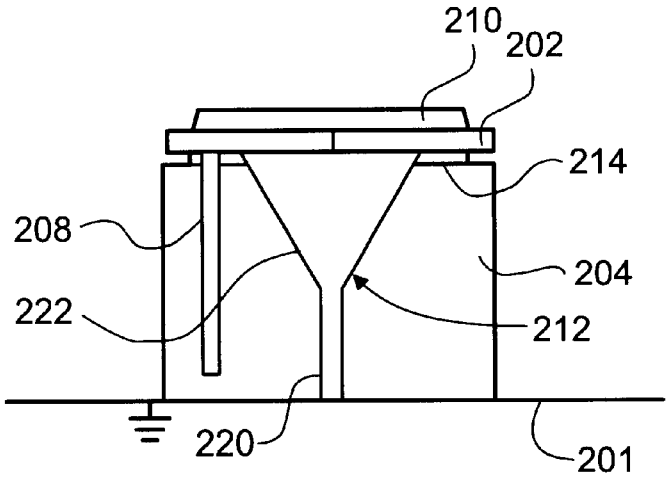
FIG. 3C is an end view of the antenna of FIGS. 3A and 3B.

FIGS. 3A–3C show an antenna 200. FIGS. 3A and 3C include different perspective views of the same antenna 200, while FIG. 3B shows a side schematic view. Antenna 200 is formed on a ground plane 201 and generally includes a vertical planar conductor 204, a signal coupling means 203, a horizontal planar conductor 202, a meander line 208 interconnecting the vertical and horizontal planar conductors 202, 204, and a third conductor 212 connecting the horizontal planar conductor 202 to ground. Also included is a shaped conductor 210 connected to horizontal conductor 202 and extending towards vertical conductor 204.

More specifically, vertical planar conductor 204 is generally oriented perpendicularly or orthogonally with respect to ground plane 201. Signal coupling means 203 is connected to planar conductor 204 proximally to ground plane 201 and couples r.f. signals for the antenna with respect to ground plane 201. Coupling signals for the antenna is intended to mean both the excitation of antenna 200 with a transmission signal and the extraction of signals sensed by antenna 200 for processing by a receiver. Planar conductor 204 also includes a substantially straight edge 214 located along the top of conductor 204 relative to ground plane 201.

Horizontal planar conductor 202 is oriented substantially parallel to ground plane 201 and thereby perpendicularly or orthogonally to planar conductor 204. Horizontal planar conductor 202 also includes a substantially straight edge 216, which is oriented parallel and proximal to edge 214 of conductor 204. These two edges 214, 216 define a gap 206 which separates conductors 204 and 202. Gap 206 creates capacitance between planar conductors 204, 202 as determined by the spacing or size of gap 206 and the proximal lengths of edges 214 and 216. Planar conductor 202 is shown to have a maximum length dimension 211 and a maximum width dimension 213 in FIG. 3A. Length dimension 211 extends from the gap 206 to an end 215 which extends away from gap 206.

Planar conductor 202 may have a triangular shape as shown in FIGS. 2 and 3A, with one comer forming the extending end 215 in the direction away from gap 206. This triangular shape may also include a pair of equilateral sides located adjacent to, or on either side of the extending corner. This triangular shape is only necessary for a further embodiment described below and is not critical to the operation of the broadest invention. Likewise planar conductors 152, 202 may have any other suitable shape which includes one end 215, extending away from the gap.

Meander line 208 is connected between planar conductors 204, 202 and across gap 206. Meander line 208 may be constructed in the same manner as meander line 108 of the prior art and may include two or more sequential sections having alternating impedance values. Although only two sections are shown for meander line 208, the actual number used will depend upon the desired electrical length for the particular application. Meander line 208 is physically mounted to vertical planar conductor 204, which creates a relative ground plane for meander line 208. FIG. 3C shows that meander line 208 has the width of a typical transmission line for the purpose of creating the relative functional impedance values thereof for the design frequencies of antenna 200.

Shaped conductor 210 is used to further enhance the capacitance created between planar conductor 204 and 202. Conductor 210 is connected to horizontal conductor 202 and extends towards vertical conductor 204, and it includes a planar section 218 which is oriented substantially parallel to vertical planar conductor 204. Conductor 210 creates additional capacitance in relation to planar conductor 204 by means of its proximity thereto. Such proximity is determined by the relative closeness of conductor 210 and 204 and the relative proximal surface areas thereof. For this reason, conductor 210 is adapted for adjustment with respect to conductor 204. In one form, conductor 210 may be made from a malleable material, such as copper, which holds its shape after being bent into the desired position. Additionally, a more precise physical spacer made of dielectric material may be placed between the conductors 210, 204. Likewise, any other suitable arrangement may be used. The addition of planar section 218 further increases capacitance by providing a greater proximal surface area.

As mentioned horizontal planar conductor 202 is connected to ground by a third conductor 212. Conductor 212 may take various forms and is shown in FIG. 3C to have a portion 220 thereof formed as a transmission line. Transmission line portion 220 may extend up to horizontal conductor 152, such as 162 of FIG. 1, or it may have some other suitable shape such as the impedance matching section 222. Conductor 212, 162 is connected to horizontal conductor 202, 162, respectively, at some point 217 between the gap and the extending end 215. This point of connection 217 may affect the resulting bandwidth characteristics of the antenna 150, 200. Point 217 may therefore be chosen to achieve a predetermined bandwidth characteristic for the antenna 200 or to otherwise determine such bandwidth characteristic. In one form, point 217 may be chosen to maximize the functional bandwidth of antenna 200. For many applications, the position of point 217 may nominally lie between one-half and two-thirds of the length 211 from gap 206 to extending end 215. The location of point 217 may also be selected in accordance with physical construction requirements of the antenna.

Conductor 212 may be oriented in parallel to vertical planar conductor 204 with a certain amount of capacitance being created, depending upon the proximity of conductor 212 to planar conductor 204 and upon the relative surface area of conductor 212. Such capacitance may be varied through control of these two aspects.

Figure 1:
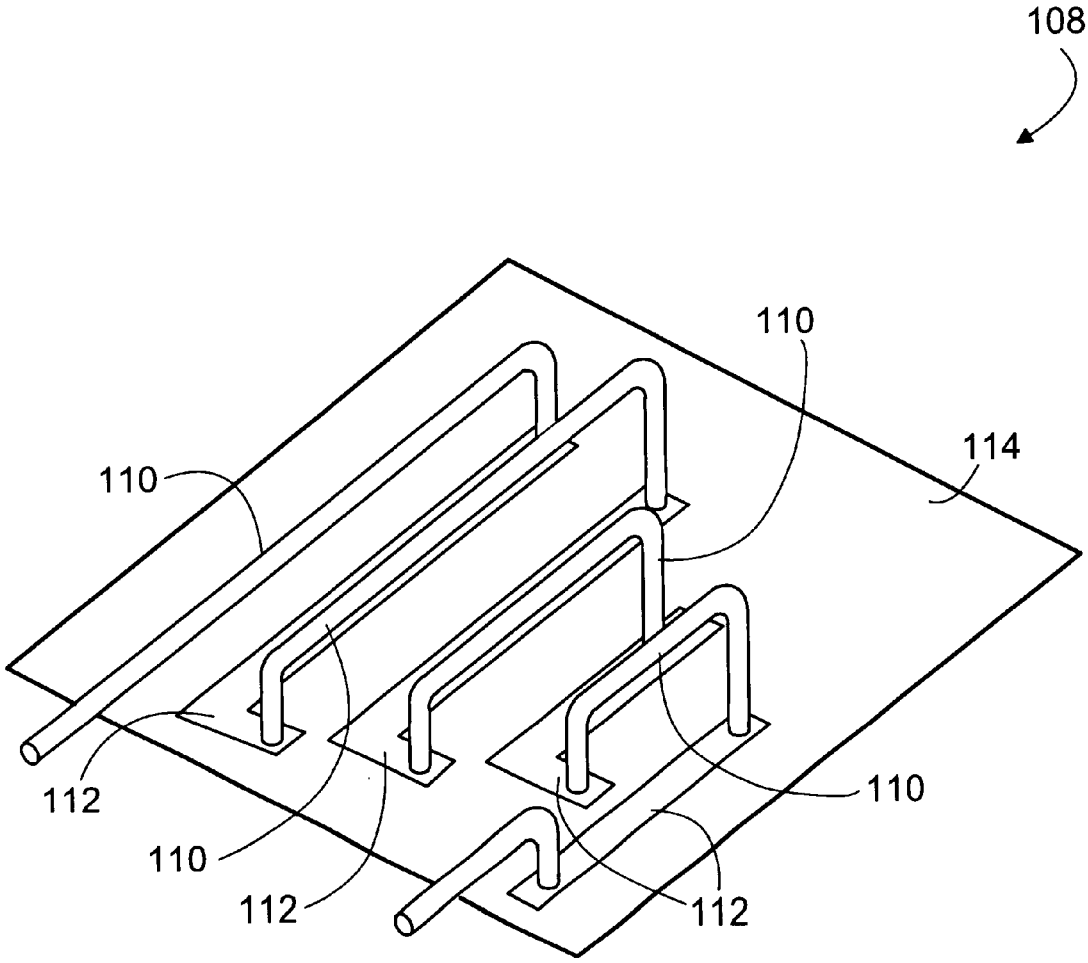
FIG. 1 is a perspective view of a meander line used by antennas of the prior art.

Conductor 212 is typically designed to have a characteristic impedance along at least a portion 220 thereof which is comparable to the overall characteristic impedance of meander line 208. The characteristic impedance of meander line 208 is nominally equal to the square root of the product of the high and low impedance values thereof. FIG. 1 shows an example of a wider conductor 162 for connecting the horizontal planar conductor 152 to ground. Such a wider conductor 162 would have the necessary characteristic impedance values at lower frequencies. The positioning of conductor 162 along horizontal conductor 152 may be dictated by the desired impedance of conductor 162 at lower frequencies and the shape of horizontal conductor 152, however inter-conductor capacitance at such lower frequencies will be less of a design consideration.

Figure 4:
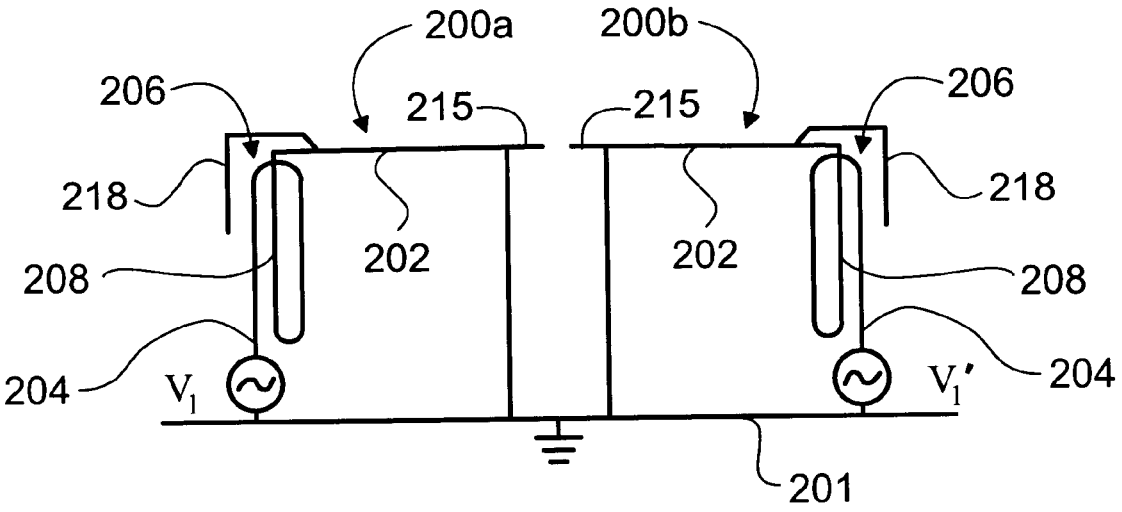
FIG. 4 is a cross-sectional schematic view of a pair of opposed MLA antennas formed with the antenna of either FIG. 2 or FIG. 3.

FIG. 4 shows a schematic sectional side view of a pair of antennas 200 oriented in an opposed position and thus forming an opposed pair of meander line loaded antennas, sharing the same ground plane 201 and having the extending ends 215 thereof being proximally located. Antennas 200*a* and 200*b* are substantially identical, with identical components of each antenna having the same reference numbers. With the combination shown in FIG. 4, the performance of a single antenna 200 may be effectively doubled. In one mode of operation, one antenna 200*a* has a transmission signal coupled thereto, and the opposed antenna 200*b* has the inverted signal coupled thereto. This arrangement causes the horizontal planar conductors 202 of both elements to appear as a single radiating element for handling signals polarized horizontally with respect to ground plane 201. Similar reception performance is also achieved. In a preferred embodiment, antennas 200*a*, 200*b* are symmetrically aligned. The horizontal planar conductors 202 are not limited to having a triangular shape, and may be any other suitable shape, such as rectangular.

In operation, the opposed pair of meander line loaded antennas 200*a*, 200*b* operates in the monopole or vertical polarization mode relative to ground plane 201, when the signal couplers $V_1$ and $V_1'$ are fed with the same signal. This same opposed pair operates in a loop mode for horizontal polarization relative to ground plane 201, When the signal couplers are fed with inverse signals, $V_1$ and $-V_1'$.

Figure 5:
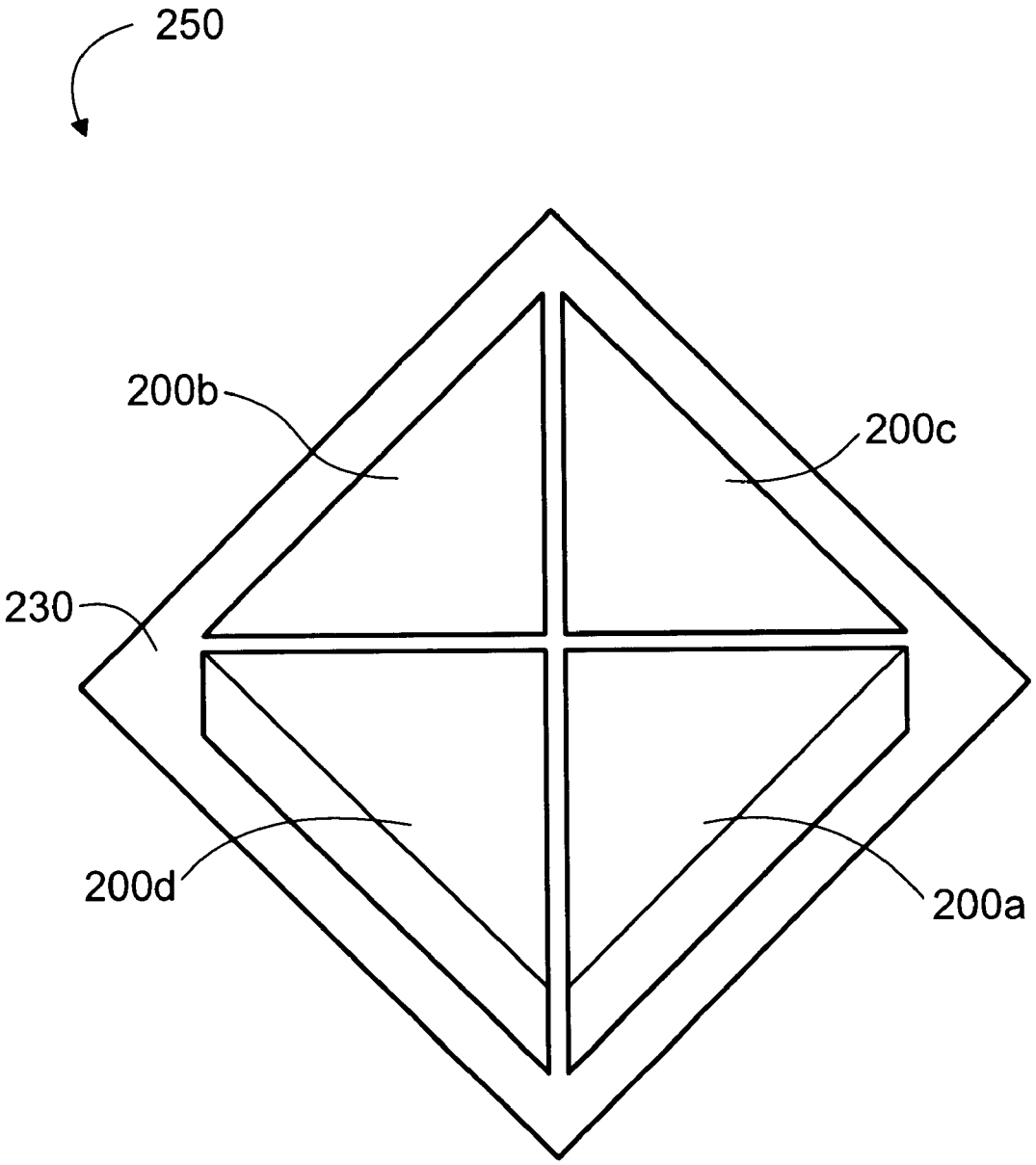
FIG. 5 is a perspective view of two pairs of opposed MLA antennas arranged in quadrature.

FIG. 5 shows a representational perspective view of two opposed pairs of meander line loaded antennas 200*a*–200*b*, 200*c*–200*d*, sharing a common ground plane 230 and forming a quadrature antenna 250. Both opposed pairs are identical and are orthogonally arranged with respect to each other, and the extending ends 215 (FIGS. 3 and 4) are all proximally located. FIG. 5 more clearly shows the symmetrical alignment of each of the opposed pairs. The triangular shape of horizontal planar conductor 202 is used in this embodiment to allow the proximal location of all of the extending comers. Because the extending ends 215 of each pair are not directly connected, circularly polarized signals created by both pairs are generated at the same central point in space and are not displaced from each other along a central axis orthogonal to ground plane 230. This provides the circularly polarized signals so generated with high polarization purity.

Figure 6:
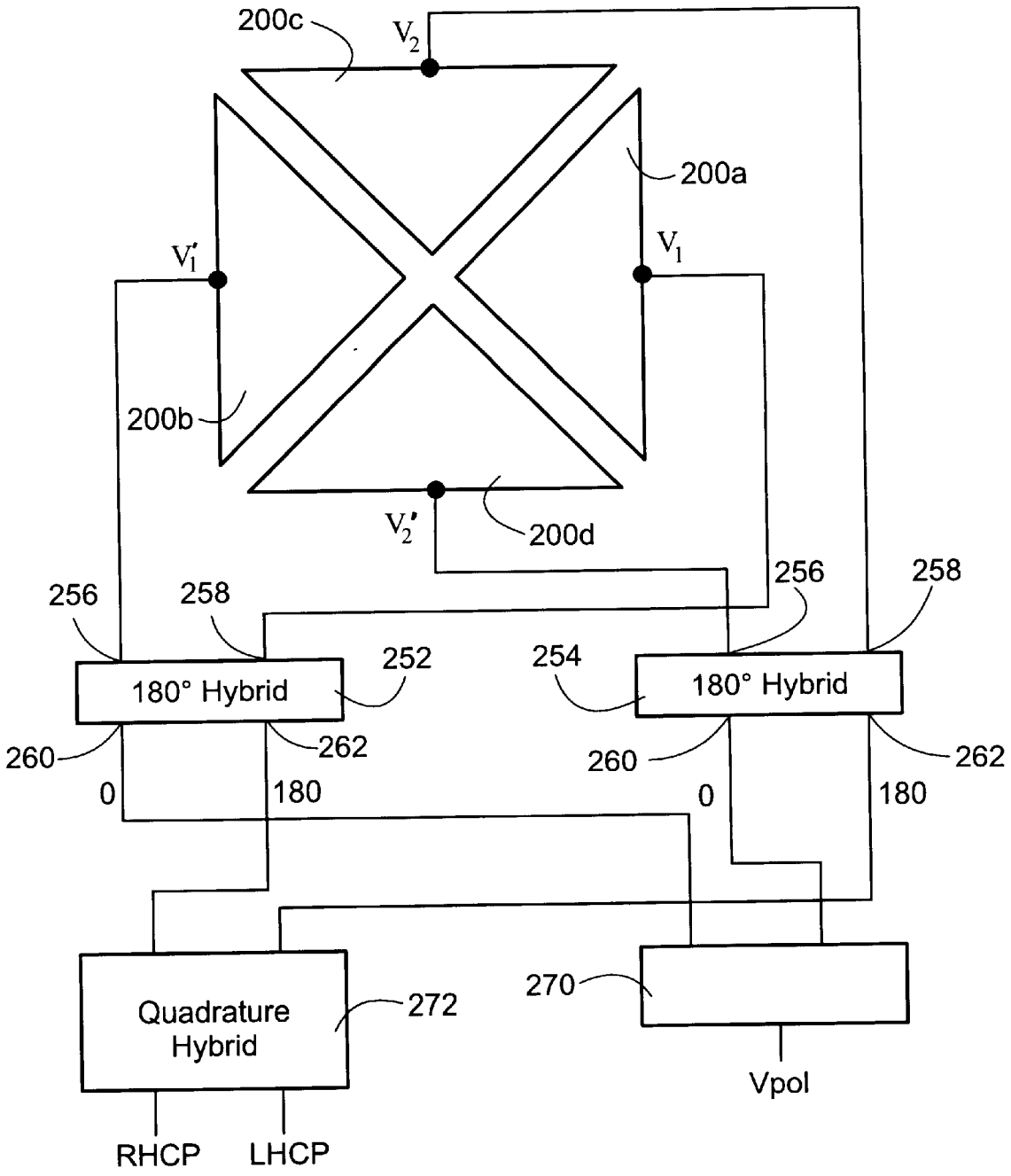
FIG. 6 is a schematic view of the antenna of FIG. 5 including circuitry used for providing quadrature coupling for the combined antenna.

FIG. 6 shows an example of coupling circuitry which may be used simultaneously for both circularly and vertically polarized signals. Each of the opposed pairs 200*a*–200*b*, 200*c*–200*d* is coupled to a respective inverse hybrid circuit 252, 254, commonly known as "180°" hybrids. Inverse hybrid circuits 252, 254 each has a pair of antenna ports 258, 256 coupled to their respective opposed antennas 200*a*–200*b*, 200*c*–200*d*, and a pair of input/output ports 260, 262. Signals coupled to the "0" input/output port 260 of each inverse hybrid are thereby coupled equally through antenna ports 256, 258, and signals coupled to the "180" input/output port 262 are coupled inversely, or out of phase through antenna ports 256, 258. Likewise in a receive mode, the "0" input/output port 260 combines the signals from both antenna ports 256, 258 with an in-phase relationship, and the "180" input/output port 262 combines the signals from both antenna ports 256, 258 with an out-of-phase relationship.

The input/output ports 260, 262 are then coupled by type, with the "0" ports 260 coupled to a simple power combiner/splitter 270 for handling vertically polarized signals and the "180" ports 262 coupled to a quadarature converter 272 to handle circularly polarized signals. By this arrangement, horizontally polarized components of a received signal are coupled by inverse hybrids 252, 254 to quadarture hybrid 272. Quadrature hybrid 272 mixes the signals with a quadrature separation to allow detection of circularly polarized signals. The quadrature mixing is performed twice with the inverse hybrid signals in different order to allow detection of both left-hand and right-hand polarized signals. In this manner, and because of the circular polarization purity of antenna 250, both directions of polarization may be simultaneously used for independent signals.

As mentioned, antenna 250 may also be simultaneously used to receive vertically polarized signals. The in-phase signals produced by inverse hybrids 252, 254 are simply combined to sum the contribution from all of the antenna elements. Also, the circuitry of FIG. 6 functions in the analogous manner for handing transmission signals. A signal coupled to either of the VPOL, LHCP or RHCP ports will be transmitted accordingly.

Figure 7:
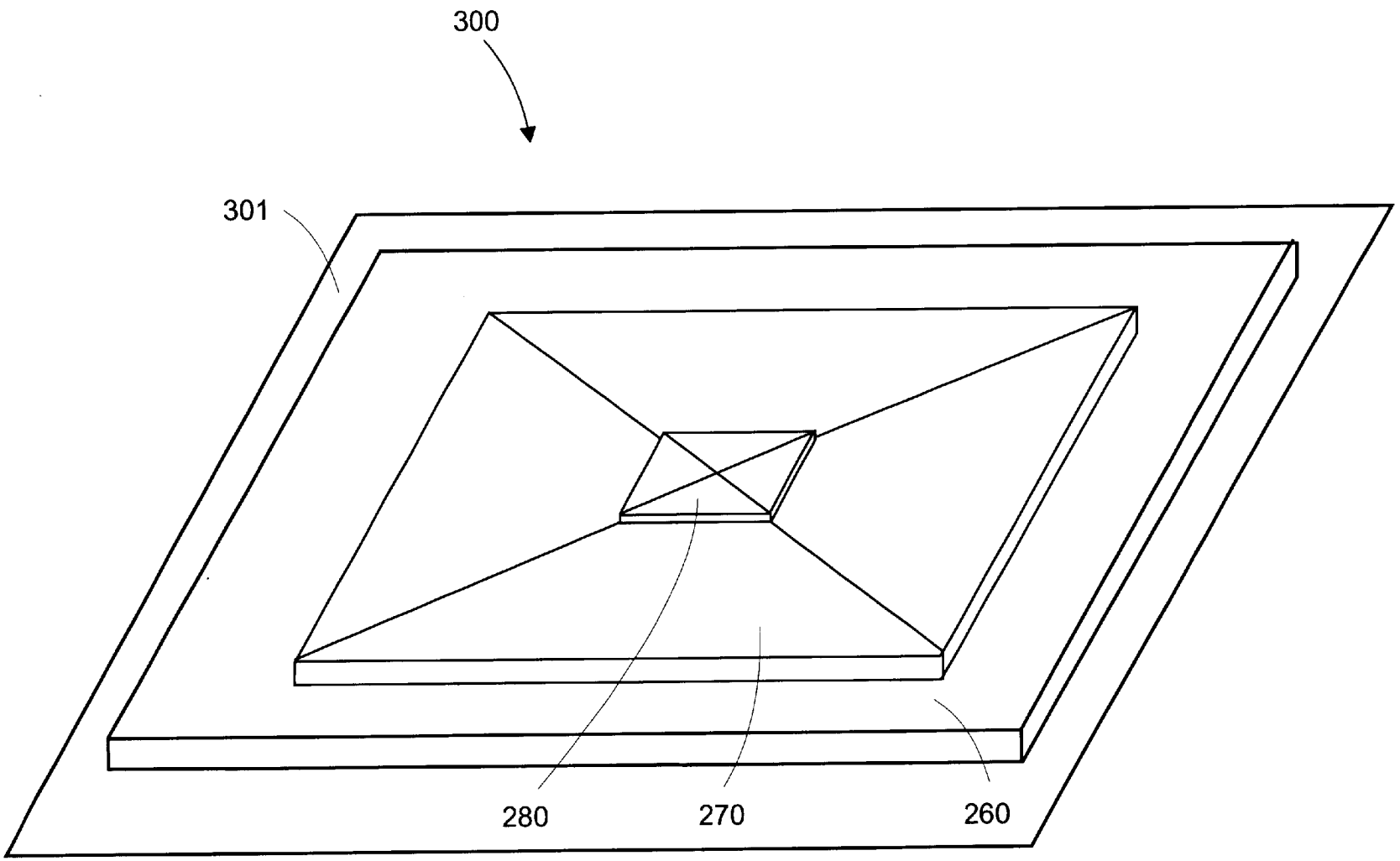
FIG. 7 is a representational perspective view of an antenna constructed in accordance with yet another embodiment of the present invention.
Figure 8:
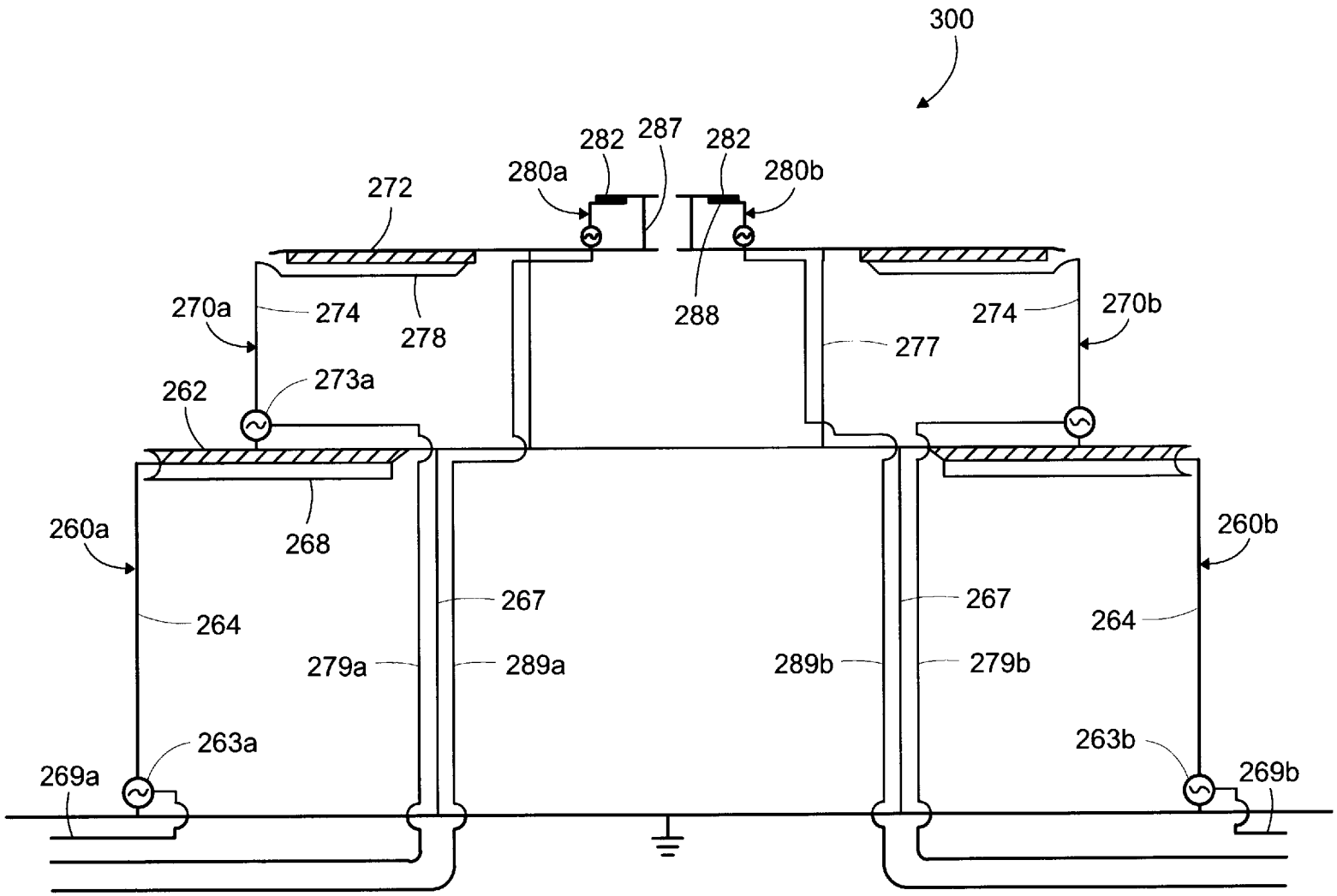
FIG. 8 is a schematic side view of a portion of the antenna of FIG. 7.

FIG. 7 shows a further embodiment of the present invention in which a multi-band quadrature antenna 300 is formed on a ground plane 301 by a multiplicity of quadrature antennas 260, 270 and 280. FIG. 8 shows a partially sectional, schematic view of a pair of opposed quadrature elements of antenna 300. One particular feature of the present application which allows multiple antenna elements to be stackable to form a multi-band antenna is that the horizontal planar conductor of each of the lower elements functions as the ground plane for the element mounted immediately on top of it. Another particular feature which allows this stacking, is the use of several of the conductors of each lower antenna element for mounting or carrying a transmission line to electrically feed the elements mounted on top of the lower element.

Throughout the discussion of FIGS. 7 and 8, discussion of individual antennas, individual opposed pairs of antennas and individual quadrature antennas applies equally to other like elements, unless stated otherwise.

More specifically, FIG. 8 shows schematic cross sections of opposed antenna pairs 260*a*–260*b*, 270*a*–270*b*, and 280*a*–280*b*. Each antenna includes, respectively, a vertical planar conductor 264, 274, 284; a horizontal planar conductor 262, 264, 274; meander line 268, 278, 288; signal coupling means 263, 273, 283; and a third conductor 267, 277, 287, all of which function in the same manner as the elements described in respect to antenna 200. Each of the higher level antennas 270*a*, 280*a* is smaller than the respective antenna 260*a*, 270*a* upon which it is mounted, with such smaller antenna being used for a higher frequency band as described below. One difference which exists between the antennas 300 and 200 is that the respective meander lines are mounted on the horizontal planar conductors as opposed to the vertical planar conductors of antenna 200. As explained in the discussion of the prior art, the meander lines may use either of those conductors as a relative ground plane to create the necessary slow wave impedance structure. Also shown for the meander lines of antenna 300 are layers of dielectric material separating the meander lines from their respective planar conductors.

As mentioned, one feature which allows the stacking of elements is that the horizontal conductor 262, 272 of each lower antenna 260*a*, 270*a*, forms the ground plane for the respective higher antenna 270*a*, 280*a* mounted thereon. This is enabled when the horizontal element of the lower antenna is sufficiently large enough to electrically appear as a ground plane to the shorter wavelengths of the higher. More specifically, each of the second planar conductors 262, 272, 282 has maximum length 211 and width 213 dimensions as described in reference to FIG. 3A. In order for the second planar conductor 262, 272 to be used as a conductor means forming a ground plane for a higher antenna 270*a*, 280*a*, respectively, those second planar conductors 262, 272 have length and width dimensions that are each approximately twenty percent (20%), or more, larger than the respective length and width dimensions of the second planar conductor 272, 282 of the meander line loaded antenna 270, 280 mounted thereon. It has been experimentally determined that this increase in dimensions of approximately twenty percent or more is sufficient to cause the lower second planar conductor to effectively function as a ground plane for the meander line loaded antenna mounted thereon.

It should be noted that the discussion herein of FIGS. 7 and 8 with respect to stacking of antennas is intended to cover both single meander line antennas stacked on one another and opposed pairs of meander line antennas stacked on one another, as well as the depicted quadrature antennas.

The other significant feature shown in FIG. 8 is the separate transmission lines 279*a*, 289*a*, etc., used for coupling signals for their respective antennas 270*a*, 280*a*, etc. These transmission lines are preferably coax shielded cables and they are each mounted on or carried by the horizontal planar conductor and the third conductor of the lower antenna 260, 270, respectively. The shielding of such signal coupling transmission lines 279*a*, 289*a* may affect the characteristic impedance of the grounded transmission line 267, however the effect can be used in the design or otherwise minimized by placement of the transmission lines 279*a*, 289*a*. The routing of transmission lines 279*a* and 289*a* is shown on separate sides of grounded transmission line 267, however they may also be located on the same side. Likewise, the particular routing of all signal coupling transmission lines may be accomplished in a variety of patterns as depicted in FIG. 8. In a preferred embodiment, these lines are all internal to the structure of antenna 300.

In one example, antenna 300 was constructed with a first quadrature antenna 260 covering the frequency range from 2 MHz to 400 MHz with length and width dimensions of 8 inches and a height dimension of 2 inches. The second quadrature antenna 270 covered a frequency range of 400 MHz to 2800 MHz with dimensions of six inches by six inches by one inch, and the third quadrature antenna 280 covered the frequency range of 2.8 GHz to 18 GHz with dimensions of one inch by one inch by 0.17 inches. Thus, the overall frequency range of the example is 9000:1. This example did vary from the schematic of FIG. 8 in that the antenna 260 was constructed using a tunable meander line as described in the prior art for the purpose of covering that frequency range at the longer wavelengths involved. Antennas 270 and 280 were constructed using the wide instantaneous bandwidth antenna 200 of the present application.

Since other modifications and changes varied to fit particular operating requirements and environments will be apparent to those skilled in the art, the invention is not considered limited to the example chosen for purposes of disclosure, and covers all changes and modifications which do not constitute departures from the true spirit and scope of this invention.

Having thus described the invention, what is desired to be protected by Letters Patent is presented in the subsequently appended claims.

What is claimed is:

1. A wideband antenna, comprising:

a first meander line loaded antenna, wherein said first antenna comprises;

a conductor means defining a first ground plane;

a first planar conductor extending orthogonally from the first ground plane;

a signal coupling means connected to the first planar conductor proximally to the first ground plane;

a second planar conductor located substantially parallel to the first ground plane and separated from the first planar conductor by a gap, with the second planar conductor having an extending end extending away from the gap;

a meander line interconnecting the first and second planar conductors across the gap; and a third conductor connecting the second planar conductor to the first ground plane, the third conductor being connected to a point on the second planar conductor between the gap and the extending end, wherein the point of connection determines a bandwidth characteristic for said wideband antenna.

2. The antenna of claim 1, further comprising:

a second meander line loaded antenna mounted on and being smaller than but otherwise identical to the said first meander line loaded antenna of claim 1, which second antenna uses the second planar conductor of the first antenna as a respective conductor means forming a second ground plane; and a transmission line mounted on the third conductor and second conductor of the first antenna for coupling signals for the second antenna.

3. The antenna of claim 2, further comprising:

a third meander line loaded antenna mounted on and being smaller than but otherwise identical to the second meander line loaded antenna of claim 2, which third antenna uses the second planar conductor of the second antenna as a respective conductor means forming a third ground plane and a second transmission line mounted on the third conductor and second conductor of the first said antenna and on the third conductor and second conductor of the second antenna for coupling signals for the third antenna.

4. The antenna of claim 3, wherein the second planar conductor of each meander line loaded antenna has maximum length and width dimensions, and further wherein each second planar conductor, used as a conductor means forming the ground plane, has length and width dimensions that are each approximately twenty percent or more larger than the respective length and width dimensions of the second planar conductor of the meander line loaded antenna mounted thereon.

5. The antenna of claim 1, further comprising a fourth meander line loaded antenna identical to the first meander line loaded antennae of claim 1 and sharing the same ground plane, wherein the first and the fourth antennas form a first opposed pair of meander line loaded antennas, with the extending end of the respective second conductors being proximally located.

6. The antenna of claim 5, further comprising:

a second opposed pair of meander line loaded antennas being smaller than but otherwise identical to the first opposed pair of claim 5, with each antenna of the second opposed pair being mounted on and using the second conductor of a separate respective antenna of the first opposed pair as a conductor means forming a ground plane; and a separate transmission line for coupling signals for each antenna of the second opposed pair, with each such transmission line being mounted on the third and second conductors of the respective meander line loaded antenna of the first opposed pair.

7. The antenna of claim 6, further comprising:

a third opposed pair of meander line loaded antennas being smaller than but otherwise identical to the second opposed pair, with each of the antennas of the third opposed pair being mounted on and using the second conductor of a separate respective antenna of the second opposed pair as a conductor means forming a ground plane; and a separate transmission line for coupling signals for each antenna of the third opposed pair, with each such transmission line being mounted on the third and second conductors of each of the respective meander line loaded antennas of the second and first opposed pairs.

8. The antenna of claim 7 wherein the second planar conductor of each meander line loaded antenna has maximum length and width dimensions, and further wherein each second planar conductor, used as a conductor means forming the respective ground plane, has length and width dimensions that are each approximately twenty percent or more larger than the respective length and width dimensions of the second planar conductor of the meander line loaded antenna mounted thereon.

9. The antenna of claim 5, further comprising:

a fourth opposed pair of meander line loaded antennas identical to the first opposed pair of meander line loaded antennas and being adapted to form a first quadrature antenna in combination with the first opposed pair, with each antenna of each opposed pair being adapted to function as a separate one of four elements of the first quadrature antenna.

10. The antenna of claim 9, further comprising:

a second quadrature antenna smaller than but otherwise identical to the first quadrature antenna of claim 9, with each separate element of the second quadrature antenna being mounted on and using the second conductor of a separate respective antenna of the first quadrature antenna as a conductor means forming a respective ground plane; and a separate transmission line for coupling signals for each element of the second quadrature antenna, with each such transmission line being mounted on the third and second conductors of the respective meander line loaded antennas of the first quadrature antenna.

11. The antenna of claim 10, further comprising a third quadrature antenna smaller than but otherwise identical to the second quadrature antenna, with each separate clement of the third quadrature antenna being mounted on and using the second conductor of a separate respective antenna of the second quadrature antenna as a conductor means forming a respective ground plane; and a separate transmission line for coupling signals for each element of the third quadrature antenna, with each such transmission line being mounted on the third and second conductors of each respective meander line loaded antenna of the second and first quadrature antenna.

12. The antenna of claim 11, wherein the second planar conductor of each meander line loaded antenna has maximum length and width dimensions, and further wherein each second planar conductor, used as a conductor means forming a respective ground plane, has length and width dimensions that are each approximately twenty percent or more larger than the respective length and width dimensions of the second planar conductor of the meander line loaded antenna mounted thereon.

13. The antenna of claim 11, wherein each transmission line for coupling signals includes a separate, shielded coaxial cable.

14. The antenna of claim 9, wherein each second planar conductor has a triangular shape with a corner thereof forming the extending end of the second conductor, and further wherein the respective corners of each meander line loaded antenna of the first quadrature antenna are proximally located.

15. The antenna of claim 1, wherein the point of connection on the second planar conductor maximizes the bandwidth characteristic for the antenna.

16. The antenna of claim 1, wherein the second planar conductor has a length which extends between the gap and the extending end, and further wherein the point of connection on the second planar conductor is located approximately one-half to two-thirds of such length from the gap to the extending end.

17. The antenna of claim 1, wherein the meander line is a slow wave structure having sequential sections with different characteristic impedance values including at least one section with a relatively lower impedance value and at least one section with a relatively higher impedance value, and further wherein the third conductor has a characteristic impedance value approximately equal to the square root of the product of the lower and higher impedance values of the meander line.

18. The antenna of claim 1, further comprising a fourth conductor connected to the second planar conductor and extending toward the first planar conductor for enhancing capacitance there between.

19. The antenna of claim 18, wherein the fourth conductor is adapted for adjustment relative to the first planar conductor to vary the capacitance there between.

20. The antenna of claim 19, wherein the fourth conductor has a planar member thereof which extends substantially parallel to the first planar conductor and is adjustable as to its proximity to the first planar conductor.

* * * * *